US011403985B2

(12) United States Patent
Takasugi et al.

(10) Patent No.: US 11,403,985 B2
(45) Date of Patent: Aug. 2, 2022

(54) DISPLAY CONTROL DEVICE, DISPLAY DEVICE AND METHOD OF CONTROLLING DISPLAY DEVICE

(71) Applicant: LG DISPLAY CO., LTD., Seoul (KR)

(72) Inventors: Shinji Takasugi, Tokyo (JP); Hyun-Jong Ji, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/907,924

(22) Filed: Jun. 22, 2020

(65) Prior Publication Data

US 2020/0402440 A1 Dec. 24, 2020

(30) Foreign Application Priority Data

Jun. 20, 2019 (JP) ..... JP2019-114322

(51) Int. Cl.
*G09G 3/20* (2006.01)
*G09G 3/3208* (2016.01)

(52) U.S. Cl.
CPC ..... *G09G 3/2003* (2013.01); *G09G 3/3208* (2013.01); *G09G 2320/0626* (2013.01); *G09G 2320/0666* (2013.01)

(58) Field of Classification Search
CPC ..... G09G 3/2003; G09G 3/3208; G09G 2330/08; G09G 2330/021;
(Continued)

(56) References Cited

U.S. PATENT DOCUMENTS 5,119,086 A * 6/1992 Nishioka ..... G09G 5/028 345/690
5,929,843 A * 7/1999 Tanioka ..... G09G 3/3607 345/600
7,808,462 B2 * 10/2010 Tanase ..... G09G 3/3208 345/83
(Continued)

FOREIGN PATENT DOCUMENTS

JP 2006-133711 A 5/2006
JP 2006-330140 A 12/2006
(Continued)

OTHER PUBLICATIONS

Office Action issued in corresponding Korea Intellectual Property Office Application No. 10-2020-0017699, dated Feb. 10, 2021.

*Primary Examiner* — Christopher E Leiby
(74) *Attorney, Agent, or Firm* — Morgan, Lewis & Bockius LLP

(57) ABSTRACT

A display control device includes: an input part receiving an input signal including gray levels of the first color, the second color and the third color constituting a color for each of the plurality of pixels; a selection part selecting at least one of the plurality of pixels as a selection pixel and other of the plurality of pixels as a non-selection pixel; and an output part outputting an output signal controlling luminances of the first sub-pixel, the second sub-pixel, the third sub-pixel and the fourth sub-pixel based on the input signal, wherein at least one of the first sub-pixel, the second sub-pixel and the third sub-pixel of the non-selection pixel is controlled to have a luminance of 0 according to the output signal, and wherein the fourth sub-pixel of the selection pixel is controlled to have a luminance of 0 according to the output signal.

23 Claims, 14 Drawing Sheets

(58) Field of Classification Search
CPC ... G09G 2320/0666; G09G 2320/0233; G09G 2320/0626; G09G 2320/045; G09G 2340/06; G09G 2360/16
See application file for complete search history.

(56) References Cited

U.S. PATENT DOCUMENTS 8,013,867 B2 * 9/2011 Higgins ..... G09G 3/3607 345/590
8,933,972 B2 * 1/2015 Polak ..... G09G 5/02 345/690
9,824,625 B2 11/2017 Jeong et al.
2005/0285828 A1 12/2005 Inoue et al.
2006/0244686 A1 * 11/2006 Higgins ..... G09G 3/3607 345/72
2007/0159492 A1 * 7/2007 Lo ..... G09G 5/026 345/589
2007/0173164 A1 * 7/2007 Johnson ..... G09G 3/22 445/6
2009/0262148 A1 * 10/2009 Kimura ..... G09G 3/2003 345/690
2010/0013748 A1 * 1/2010 Cok ..... H04N 9/67 345/83
2010/0259569 A1 * 10/2010 Inuzuka ..... H04N 11/06 345/690
2010/0315449 A1 * 12/2010 Chaji ..... G09G 3/2003 345/690
2015/0062192 A1 * 3/2015 Kim ..... G09G 3/3291 345/690
2016/0055803 A1 * 2/2016 Kim ..... G09G 3/3291 345/691
2017/0116914 A1 4/2017 Jeong et al.
2017/0213496 A1 * 7/2017 Hsu ..... H01L 27/3213
2017/0256193 A1 * 9/2017 Zhou ..... G09G 3/3607
2020/0058265 A1 * 2/2020 He ..... G09G 5/02

FOREIGN PATENT DOCUMENTS

KR 10-2016-0123440 A 10/2016
KR 10-2017-0046861 A 5/2017

* cited by examiner

DISPLAY CONTROL DEVICE, DISPLAY DEVICE AND METHOD OF CONTROLLING DISPLAY DEVICE

CROSS REFERENCE TO RELATED APPLICATIONS

The present application claims the priority benefit of Japanese Patent Application No. 2019-114322 filed in the Japan Patent Office on Jun. 20, 2019, which is hereby incorporated by reference in its entirety for all purposes as if fully set forth herein.

BACKGROUND

Technical Field

The present disclosure relates to a display control device, a display device and a method of controlling a display device.

Discussion of the Related Art

In a Japanese Patent Publication No. 2006-133711, a signal processing circuit for an emissive display including four color sub-pixels of red, green, blue and white colors is disclosed. The signal processing circuit has a function converting an RGB input signal to an RGBW signal.

In the signal conversion as described in the Japanese Patent Publication No. 2006-133711, one of the four sub-pixels may have a luminance of 0. Voltages applied to a transistor belong to the one sub-pixel having the luminance of 0 and a transistor belong to the other sub-pixel having a luminance other than 0 are greatly different from each other. Since a threshold voltage variation depends on the transistor, a compensation of the threshold voltage may not be adequately applied to the two transistors having different applied voltages.

SUMMARY

Accordingly, embodiments of the present disclosure are directed to a display control device, a display device, and a method of controlling a display device that substantially obviate one or more of the problems due to limitations and disadvantages of the related art.

An object of the present disclosure is to provide a display control device, a display device and a method of controlling a display device where a compensation of a threshold voltage variation of a transistor in a pixel of a display device.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, a display control device for controlling a display device including a display unit having a plurality of pixels each including a first sub-pixel of a first color, a second sub-pixel of a second color, a third sub-pixel of a third color and a fourth sub-pixel of a fourth color, comprises: an input part receiving an input signal including gray levels of the first color, the second color and the third color constituting a color for each of the plurality of pixels; a selection part selecting at least one of the plurality of pixels as a selection pixel and other of the plurality of pixels as a non-selection pixel; and an output part outputting an output signal controlling luminances of the first sub-pixel, the second sub-pixel, the third sub-pixel and the fourth sub-pixel based on the input signal, wherein at least one of the first sub-pixel, the second sub-pixel and the third sub-pixel of the non-selection pixel is controlled to have a luminance of 0 according to the output signal, and wherein the fourth sub-pixel of the selection pixel is controlled to have a luminance of 0 according to the output signal.

In another aspect, a display device comprises: a display unit having a plurality of pixels each including a first sub-pixel of a first color, a second sub-pixel of a second color, a third sub-pixel of a third color and a fourth sub-pixel of a fourth color; and a display control device for controlling the display device, the display control device including: an input part receiving an input signal including gray levels of the first color, the second color and the third color constituting a color for each of the plurality of pixels; a selection part selecting at least one of the plurality of pixels as a selection pixel and other of the plurality of pixels as a non-selection pixel; and an output part outputting an output signal controlling luminances of the first sub-pixel, the second sub-pixel, the third sub-pixel and the fourth sub-pixel based on the input signal, wherein at least one of the first sub-pixel, the second sub-pixel and the third sub-pixel of the non-selection pixel is controlled to have a luminance of 0 according to the output signal, wherein the fourth sub-pixel of the selection pixel is controlled to have a luminance of 0 according to the output signal.

In another aspect, a method of controlling a display device including a display unit having a plurality of pixels each including a first sub-pixel of a first color, a second sub-pixel of a second color, a third sub-pixel of a third color and a fourth sub-pixel of a fourth color, comprises: inputting an input signal including gray levels of the first color, the second color and the third color constituting a color for each of the plurality of pixels; selecting at least one of the plurality of pixels as a selection pixel and other of the plurality of pixels as a non-selection pixel; and outputting an output signal controlling luminances of the first sub-pixel, the second sub-pixel, the third sub-pixel and the fourth sub-pixel based on the input signal, wherein at least one of the first sub-pixel, the second sub-pixel and the third sub-pixel of the non-selection pixel is controlled to have a luminance of 0 according to the output signal, and wherein the fourth sub-pixel of the selection pixel is controlled to have a luminance of 0 according to the output signal.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles. In the drawings.

DETAILED DESCRIPTION

Figure 1:
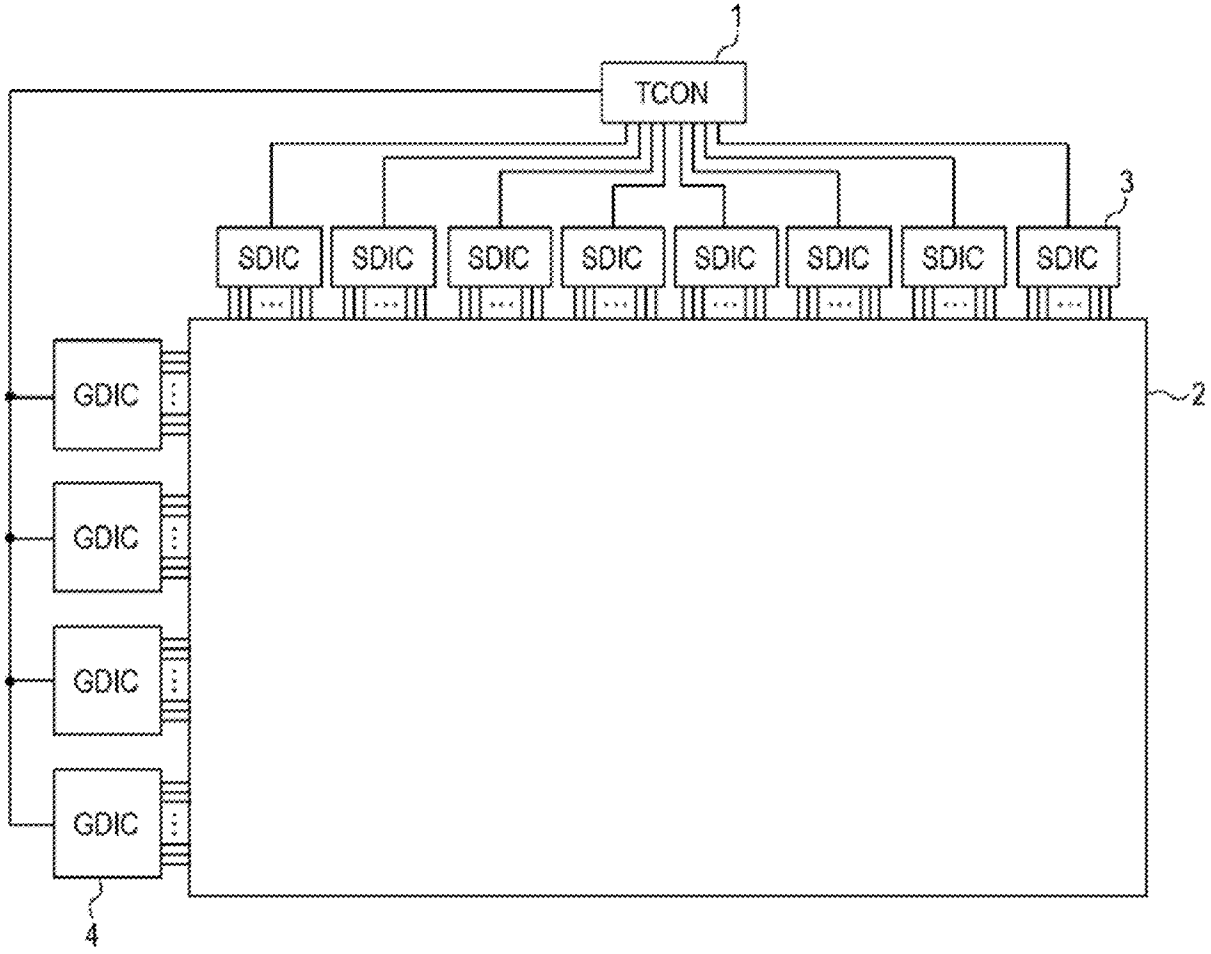
FIG. 1 is a view showing a display device according to a first embodiment of the present disclosure.

Reference will now be made in detail to embodiments of the present disclosure, examples of which may be illustrated in the accompanying drawings. In the following description, when a detailed description of well-known functions or configurations related to this document is determined to unnecessarily cloud a gist of the inventive concept, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a particular order. Like reference numerals designate like elements throughout. Names of the respective elements used in the following explanations are selected only for convenience of writing the specification and may be thus different from those used in actual products.

Advantages and features of the present disclosure, and implementation methods thereof will be clarified through following example embodiments described with reference to the accompanying drawings. The present disclosure may, however, be embodied in different forms and should not be construed as limited to the example embodiments set forth herein. Rather, these example embodiments are provided so that this disclosure may be sufficiently thorough and complete to assist those skilled in the art to fully understand the scope of the present disclosure. Further, the present disclosure is only defined by scopes of claims.

Reference will now be made in detail to the present disclosure, examples of which are illustrated in the accompanying drawings.

FIG. 1 is a view showing a display device according to a first embodiment of the present disclosure. A display device according to a first embodiment of the present disclosure is a device displaying an image in a display unit based on an inputted RGB data. For example, the display device may include an organic light emitting diode (OLED) display using a light emitting diode as an emissive element. In addition, the display device may be used as an image output device of a computer, a television, a smart phone and a game console, etc. However, the usage of the display device is not limited thereto.

In FIG. 1, a display device includes a timing controller (TCON) 1, a panel 2, a plurality of source driver integrated circuits (SDIC) 3 and a plurality of gate driver integrated circuits (GDIC) 4. The panel 2 includes a plurality of pixels disposed in a matrix and functions as a display unit displaying an image.

The timing controller 1 is communicatively connected to the plurality of source driver ICs 3 and the plurality of gate driver ICs 4. The timing controller 1 controls an operation timing of the plurality of source driver ICs 3 and the plurality of gate driver ICs 4 based on timing signals (a vertical synchronization signal, a horizontal synchronization signal, a data enable signal, etc.) inputted from an external system. In addition, the timing controller 1 generates an RGBW data representing a luminance of each sub-pixel of the panel 2 based on an RGB data inputted as an input signal from the external system and outputs the RGBW data as an output signal to the plurality of source driver ICs 3. A number of the plurality of source driver ICs 3 and the plurality of gate driver ICs 4 is not limited thereto.

Each of the plurality of source driver ICs 3 supplies a voltage (an image signal) for driving the plurality of pixels in the panel 2 through a plurality of data lines according to a control of the timing controller 1. Each of the plurality of gate driver ICs 4 supplies a scan signal to the plurality of pixels in the panel 2 through a plurality of gate lines according to a control of the timing controller 1. The timing controller 1 functions as a display control device controlling operation of the whole display device.

Figure 2:
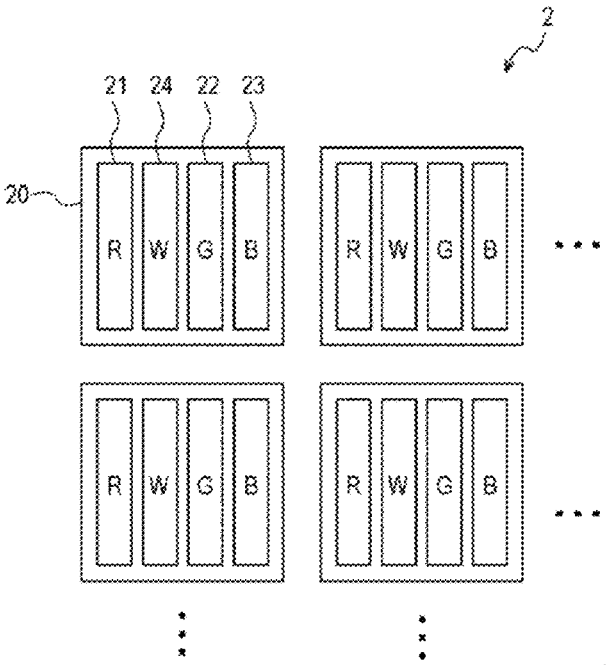
FIG. 2 is a view showing a pixel and a sub-pixel of a panel of a display device according to a first embodiment of the present disclosure.

FIG. 2 is a view showing a pixel and a sub-pixel of a panel of a display device according to a first embodiment of the present disclosure. In FIG. 2, the panel 2 includes the plurality of pixels 20 disposed in a plurality of rows and a plurality of columns. Each of the plurality of pixels 20 includes a sub-pixel 21 emitting a red colored light, a sub-pixel 22 emitting a green colored light, a sub-pixel 23 emitting a blue colored light and a sub-pixel 24 emitting a white colored light. A luminance of the sub-pixels 21, 22, 23 and 24 is controlled according to a voltage outputted from the plurality of source driver ICs 3. Since the sub-pixels 21, 22, 23 and 24 emit lights having a specific luminance ratio, the pixel 20 displays various colors due to an additive color mixture.

Since the display device includes the sub-pixel 24 of a white color, the display device has a pixel structure corresponding to a four color display of RGBW. Colors of the sub-pixels 21, 22, 23 and 24 may be defined by a transmission color (wavelength dependency of transmittance) of a color filter between the light emitting diode and an emission surface. For example, the sub-pixel 21 of a red color may be formed by disposing a red color filter on the light emitting diode of a white color, and the sub-pixel 22 of a green color may be formed by disposing a green color filter on the light emitting diode of a white color. The sub-pixel 23 of a blue color may be formed by disposing a blue color filter on the light emitting diode of a white color, and the sub-pixel 24 of a white color may be formed by disposing a transparent color filter on the light emitting diode of a white color or of the light emitting diode of a white color without a color filter.

Since the sub-pixel 24 of a white color has a relatively small energy loss due to the color filter, the sub-pixel 24 of a white color has a relatively high luminance as compared with a power consumption. Since a white color is a mixed color of red, green and blue colors, the white color has red, green and blue components. Since a display is performed by substituting a part of red, green and blue colors with the sub-pixel 24 of a white color, a power consumption of the display device is reduced.

The red, green, blue and white colors may be referred to as first, second, third and fourth colors, respectively. The sub-pixels 21, 22, 23 and 24 of the red, green, blue and white colors may be referred to as first, second, third and fourth sub-pixels, respectively. The red, green and blue color filters may be referred to as first, second and third color filters, respectively.

Figure 3:
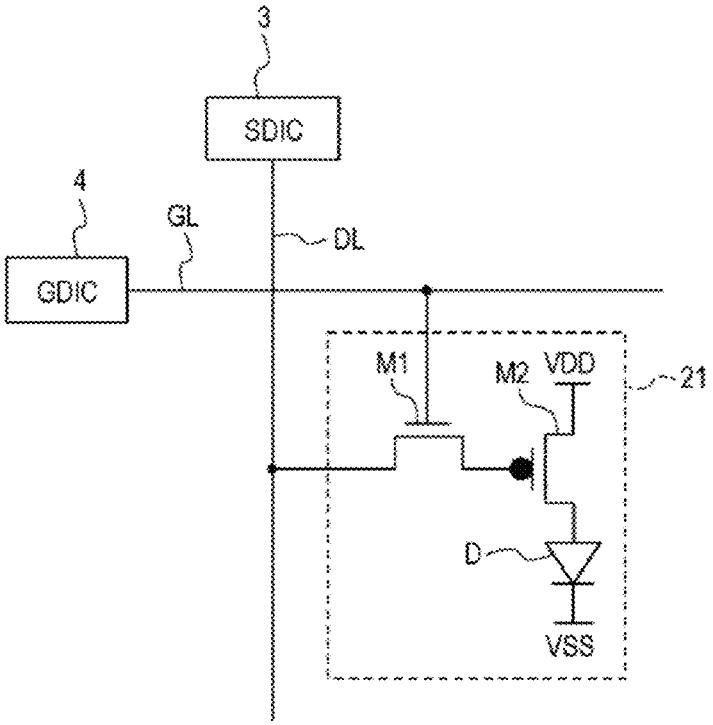
FIG. 3 is a view showing a sub-pixel of a panel of a display device according to a first embodiment of the present disclosure.

FIG. 3 is a view showing a sub-pixel of a panel of a display device according to a first embodiment of the present disclosure. In FIG. 3, one of the plurality of pixels 20 includes the sub-pixel 21, and the sub-pixel 21 is connected to the source driver IC 3 and the gate driver IC 4. Although not shown, the sub-pixels 22, 23 and 24 have the same structure as the sub-pixel 21.

The sub-pixel 21 includes a scan transistor M1, a driving transistor M2 and a diode D. The diode is an emission element of the display device. For example, the diode may be a light emitting diode. For example, the scan transistor M1 and the driving transistor M2 may be a thin film transistor (TFT). The scan transistor M1 and the driving transistor M2 may have a negative (n) channel type. In another embodiment, the scan transistor M1 and the driving transistor M2 may have a positive (p) channel type. When the driving transistor M2 has a p channel type, a circuit structure of the sub-pixel 21 may be different from that of FIG. 3.

A cathode of the diode D is connected to a voltage line supplying a low level voltage VSS. An anode of the diode D is connected to a source of the driving transistor M2. A drain of the driving transistor M2 is connected to a voltage line supplying a high level voltage VDD. A gate of the driving transistor M2 is connected to a source of the scan transistor M1.

A drain of the scan transistor M1 is connected to a data line DL. The source driver IC 3 supplies an image signal to the drain of the scan transistor M1 through the data line DL. A gate of the scan transistor M1 is connected to a gate line GL. The gate driver IC 4 supplies a control signal to the gate of the scan transistor M1 through the gate line GL. The scan transistor M1 is controlled to be turned on or off according to a level of the control signal inputted to the gate of the scan transistor M1.

A current flowing between the drain and the source of the driving transistor M2 is controlled based on a voltage (the image signal) inputted to the gate of the driving transistor M2 from the source driver IC 3 through the data line DL and the scan transistor M1. The current flowing between the drain and the source of the driving transistor M2 is supplied to the diode D, and the diode D emits a light with a luminance according to the current. As a result, the diode D emits a light with a luminance according to the image signal inputted to the sub-pixel 21.

Figure 4:
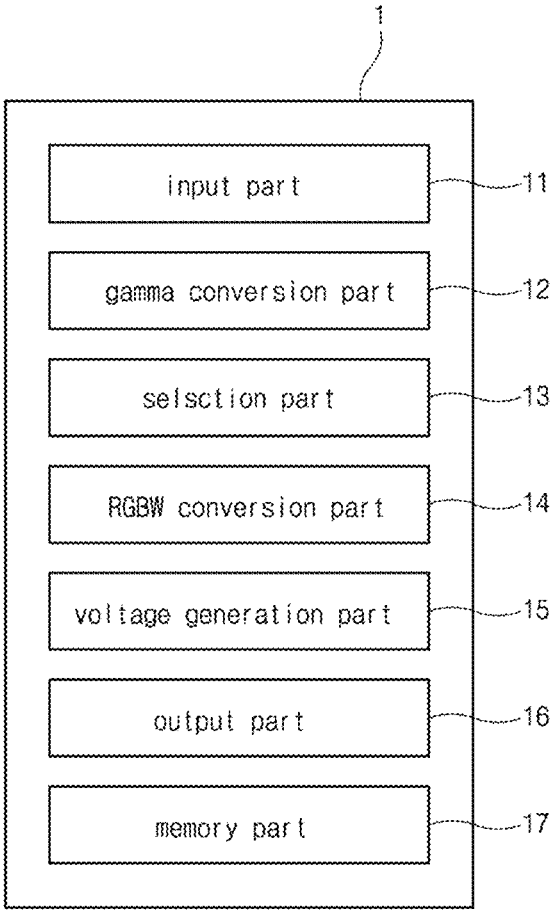
FIG. 4 is a view a timing controller of a display device according to a first embodiment of the present disclosure.

FIG. 4 is a view a timing controller of a display device according to a first embodiment of the present disclosure. In FIG. 4, the timing controller 1 includes an input part 11, a gamma conversion part 12, selection part 13, an RGBW conversion part 14, a voltage generation part 15, an output part 16 and a memory part 17. The input part 11 is an input interface of the timing controller 1. The output part 16 is an output interface of the timing controller 1. The selection part 13, the RGBW conversion part 14 and the voltage generation part 15 have an information processing function for the timing controller 1. The function of the selection part 13, the RGBW conversion part 14 and the voltage generation part 15 may be performed by a digital logic circuit or by a processor executing a program. The memory part 17 may be a memory installed in the timing controller 1. The memory 17 may be installed in an exterior of the timing controller 1.

Figure 5:
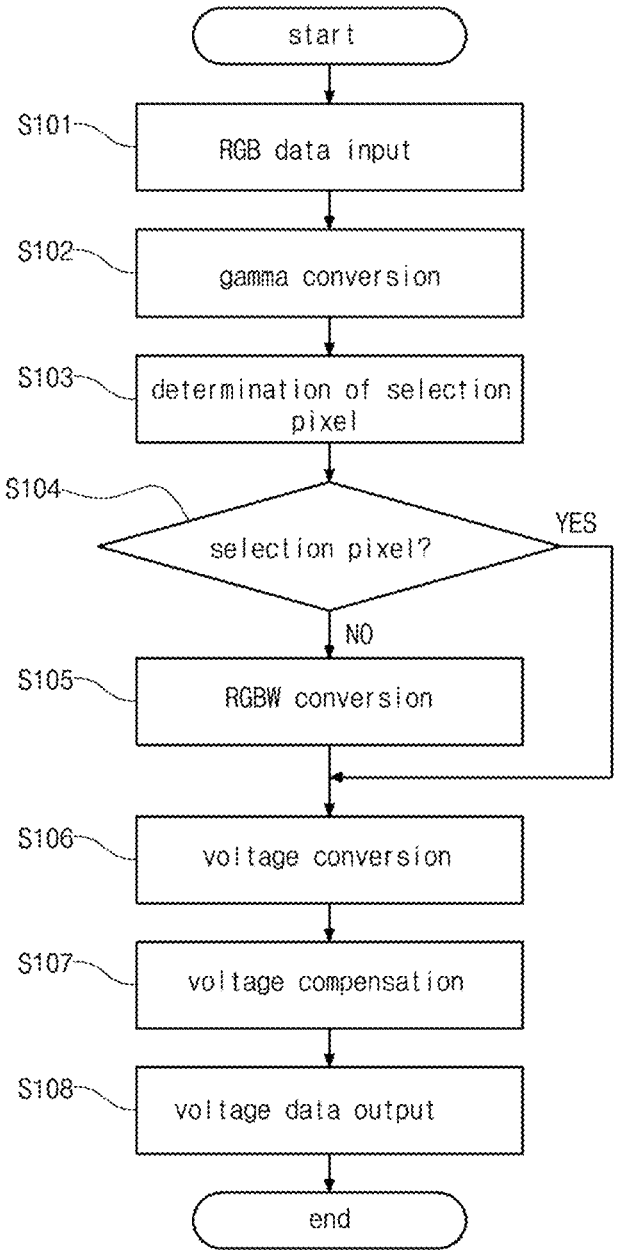
FIG. 5 is a flow chart showing a process in a timing controller of a display device according to a first embodiment of the present disclosure.

FIG. 5 is a flow chart showing a process in a timing controller of a display device according to a first embodiment of the present disclosure. In FIG. 5, a process is performed at each timing when the display device displays an image. For example, when the display device displays an image of 120 frames for 1 second, the process is performed at each display timing by 1/120 second.

At a step S101, an RGB data is inputted to the input part 11. The RGB data represents gray levels of red, green and blue components of a color displayed by each of the plurality of pixels 20. For example, the gray levels of the RGB data may have a 10 bit data. Each of a gray level $L_R$ of a red color, a gray level $L_G$ of a green color and a gray level $L_B$ of a blue color may have a gray level value of 0 to 1023. The color for the pixel 20 is represented by a combination of 3 gray level values.

At a step S102, the gamma conversion part 12 performs a gamma conversion for converting the gray level of the inputted RGB data into a luminance of the display device. As a result, an adequate image based on a gamma characteristic may be displayed by the display device. For example, the gray level $L_R$ of a red color, the gray level $L_G$ of a green color and a gray level $L_B$ of a blue color may be substituted with a luminance ratio $Y_R$ of a red color, a luminance ratio $Y_G$ of a green color and a luminance ratio $Y_B$ of a blue color, respectively, through calculation using a conversion equation including a gamma value. Each luminance ratio may be expressed by a ratio of each color with respect to a maximum luminance (ex. percentage within range of 0% to 100%).

At a step S103, the selection part 13 determines whether each of the plurality of pixels 20 is a selection pixel excluded from an object of an RGBW conversion of the step S105. When one of the plurality of pixels 20 is the selection pixel (YES of step S104), the RGBW conversion of the step S105 for the one of the plurality of pixels 20 is omitted and the step S106 is performed. When one of the plurality of pixels 20 is not the selection pixel (NO of step S104), the RGBW conversion of the step S105 for the one of the plurality of pixels 20 is performed. The detailed selection process will be illustrated hereinafter.

At a step S105, the RGBW conversion part 14 performs an RGBW conversion converting the luminance ratio corresponding to the RGB data into a luminance ratio corresponding to the RGBW data. The RGBW conversion will be illustrated with reference to FIG. 6.

Figure 6:
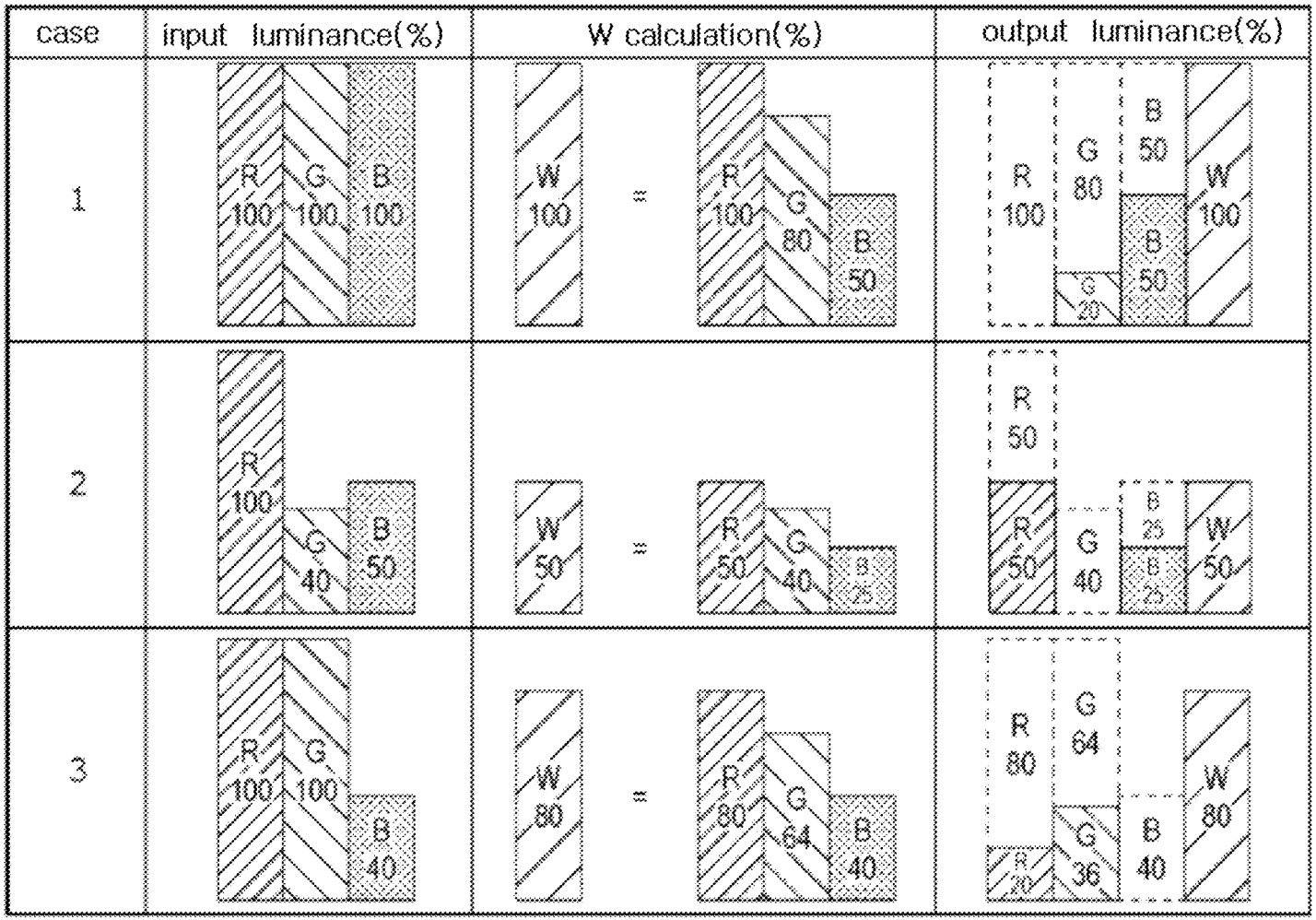
FIG. 6 is a view showing an RGBW conversion of a display device according to a first embodiment of the present disclosure.

FIG. 6 is a view showing an RGBW conversion of a display device according to a first embodiment of the present disclosure. In FIG. 6, the RGBW conversion is a process of generating the RGBW data for displaying the same color as the inputted RGB data. The white colored light emitted from the sub-pixel 24 of a white color includes red, green and blue components. As a result, the RGBW data may be generated by substituting a portion of the inputted RGB data with the white colored light. For example, the RGBW conversion may be performed for 3 input luminance signals different from each other.

In a case 1 of FIG. 6, as shown an 'input luminance (%)' column, luminances of red, green and blue colors in an input luminance (luminance of RGB data) are 100%. The case 1 is an example of the pixel 20 displaying a white colored light. A 'W calculation (%)' shows ratios of the red, green and blue colors in the white colored light emitted from the sub-pixel 24 of a white color when the luminance of the sub-pixel 24 of a white color is 100%. Since the color of the light emitted from the sub-pixel 24 of a white color depends on an emission spectrum of the light emitting diode, the color of the light emitted from the sub-pixel 24 of a white colons not equal to the white color (mixed color where the red, green and blue colors having the same ratios are mixed) of the input luminance signal. The white colored light emitted from the sub-pixel 24 of a white color has a mixed color where the red color of the ratio of 100%, the green color of the ratio of 80% and the blue color of the ratio of 50% are mixed. As a result, the green and blue colors are smaller than the red color in the white colored light emitted from the sub-pixel 24 of a white color, and the white colored light emitted from the sub-pixel 24 of a white color is different from a white colored light where the red, green and blue colors are mixed with the same ratios. Although the red, green and blue colors have the mixed ratios of 100%, 80% and 50% in the first embodiment, the red, green and blue colors may have different mixed ratios according to a material, etc., for the light emitting diode in another embodiment.

To adjust the difference of colors, the luminance of the sub-pixel 24 of a white color is determined as 100% as shown in an 'output luminance (%)' column, and the luminances of the sub-pixel 22 of a green color and the sub-pixel 23 of a blue color are determined as 20% and 50%, respectively. As a result, the green and blue colors insufficient in the white colored light emitted from the sub-pixel 24 of a white color are compensated, and the white colored light the same as the white colored light of the RGB data is outputted from the pixel 20. Since the red color is displayed by the sub-pixel 24 of a white color, the luminance of the sub-pixel 21 of a red color is 0%.

In a case 2 of FIG. 6, luminances of red, green and blue colors in an input luminance (luminance of RGB data) are 100%, 40% and 50%, respectively. The luminance of the sub-pixel 24 of a white color is determined as 50%, and the luminances of the sub-pixel 21 of a red color and the sub-pixel 23 of a blue color are determined as 50% and 25%, respectively, for compensating the insufficient red and blue colors. As a result, the white colored light the same as the white colored light of the RGB data is outputted from the pixel 20. Since the green color is displayed by the sub-pixel 24 of a white color, the luminance of the sub-pixel 22 of a green color is 0%.

In a case 3 of FIG. 6, luminances of red, green and blue colors in an input luminance (luminance of RGB data) are 100%, 100% and 40%, respectively. The luminance of the sub-pixel 24 of a white color is determined as 80%, and the luminances of the sub-pixel 21 of a red color and the sub-pixel 22 of a green color are determined as 20% and 36%, respectively, for compensating the insufficient red and green colors. As a result, the white colored light the same as the white colored light of the RGB data is outputted from the pixel 20. Since the blue color is displayed by the sub-pixel 24 of a white color, the luminance of the sub-pixel 23 of a blue color is 0%.

An algorithm of determining an output luminance will be illustrated hereinafter. A red component $W_R$, a green component $W_G$ and a blue component $W_B$ of the white colored light emitted from the sub-pixel 24 of a white color may be calculated from the luminance ratio $Y_R$ of a red color, the luminance ratio $Y_G$ of a green color and the luminance ratio $Y_B$ of a blue color in the input luminance according to the following equations.

$$W_R = Y_R/1$$

$$W_G = Y_G/0.8$$

$$W_B = Y_B/0.5$$

Next, a luminance ratio $Y_W$ of a white color in the output luminance is determined according to the following equation.

$$Y_W = \min(W_R, W_G, W_B)$$

For example, the luminance ratio $Y_W$ of a white color may be determined to be equal to a minimum value among the red component $W_R$, the green component $W_G$ and the blue component $W_B$.

The luminance ratios of colors other than a white color is modified according to the following equations. As a result, after the red, green and blue colors are modified, luminance ratios $Y_R'$, $Y_G'$ and $Y_B'$ are determined.

$$Y_R' = Y_R - 1Y_W$$

$$Y_G' = Y_G - 0.8Y_W$$

$$Y_B' = Y_B - 0.5Y_W$$

In the above equations for calculating the luminance ratios $Y_R'$, $Y_G'$ and $Y_B'$ of the red, green and blue colors after modification, $Y_W$ is one of $Y_R/1$, $Y_G/0.8$ and $Y_B/0.5$. As a result, at least one of the luminance ratios $Y_R'$, $Y_G'$ and $Y_B'$ after modification absolutely becomes 0 in the algorithm.

Since a portion of the inputted RGB data is substituted with the white colored light, the luminances of the sub-pixels 21, 22 and 23 of red, green and blue colors are reduced or become 0. As a result, the power consumption of the display device is reduced. In the RGBW conversion, at least one of the red, green and blue colors becomes 0 for any ratio of the inputted RGB data. Accordingly, the luminance of the at least one of the sub-pixels 21, 22 and 23 of red, green and blue colors may be determined as 0 by using the algorithm.

When the RGBW data has a bit number of 10 bits for each color, 40 bits are required for the red, green, blue and white colors. However, in the RGBW conversion according to the first embodiment, there exists a limitation such that the at least one of the red, green and blue colors has a luminance of 0. As a result, the information of the output luminance may be completely represented by 32 bits of 30 bits for three of the red, green, blue and white colors and 2 bits for one of the red, green, blue and white colors having a luminance of 0. Accordingly, in the RGBW conversion according to the first embodiment, an amount of information communication for transmitting the RGBW data is reduced due to the luminance of 0 of the at least one of the red, green and blue colors.

The RGBW conversion of the step S105 is not performed to the pixel 20 determined as the selection pixel in the step S103. The luminance ratio $Y_R$ of a red color, the luminance ratio $Y_G$ of a green color and the luminance ratio $Y_B$ of a blue color in the input luminance are intactly used in a subsequent process. When the luminance ratio $Y_R$ of a red color, the luminance ratio $Y_G$ of a green color and the luminance ratio $Y_B$ of a blue color are not 0, the luminance of the sub-pixel 24 of a white color may become 0. As a result, the luminance of the at least one of the red, green, blue and white colors for all the pixels 20. While the display device according to the first embodiment is driven, at least one of the sub-pixels 21, 22, 23 and 24 of the red, green, blue and white colors is turned off for all the pixels 20.

At a step S106, the voltage generation part 15 calculates a voltage outputted from the source driver IC 3 to the data line DL corresponding to the sub-pixels 21, 22, 23 and 24 based on the RGB data or the RGBW data. The voltage calculation is performed by using a relation equation of a voltage and a luminance based on characteristics of the driving transistor M2 and the diode D. The sub-pixels 21, 22, 23 and 24 correspond to the voltages $V_R$, $V_G$, $V_B$ and $V_W$, respectively. For example, the voltages may be within a range of 0V to 10V.

At step S107, the voltage generation part 15 performs a voltage compensation compensating variation of a mobility and a threshold voltage of the driving transistor M2. For example, compensated voltages $V_R'$, $V_G'$, $V_B'$ and $V_W'$ may be calculated by compensating the voltages $V_R$, $V_G$, $V_B$ and $V_W$ obtained in the step S106 according to the following equations.

$$V_R' = \mu_R^{-1/2} V_R + Vth_R$$

$$V_G' = \mu_G^{-1/2} V_G + Vth_G$$

$$V_B' = \mu_B^{-1/2} V_B + Vth_B$$

$$V_W' = \mu_W^{-1/2} V_W + Vth_W$$

Here, $\mu_R$, $\mu_G$, $\mu_B$, $\mu_W$ are conversion parameters for mobility compensation, and $Vth_R$, $Vth_G$, $Vth_B$ and $Vth_W$ are conversion parameters for threshold voltage compensation.

At a step S108, the output part 16 outputs the RGBW data corresponding to the output voltage from the source driver IC 3 to the pixel 20 based on the voltages $V_R'$, $V_G'$, $V_B'$ and $V_W'$ calculated in the step S107. The source driver IC 3 outputs a voltage controlling the driving transistor M2 of the sub-pixels 21, 22, 23 and 24 through the data line DL based on the RGBW data. Although at least one of the sub-pixels 21, 22, 23 and 24 has a luminance of 0, a voltage equal to or smaller than the threshold voltage is supplied to the data line connected to the sub-pixel of the luminance of 0 so that the driving transistor M2 cannot be turned on.

In the display device according to the first embodiment, the four color display of RGBW is performed through the RGBW conversion to the inputted RGB data. As shown the steps S103 to S105, the RGBW conversion is not performed to the selection pixel selected by the selection part 13. The detailed process and the reason for the process will be illustrated hereinafter.

Figure 7:
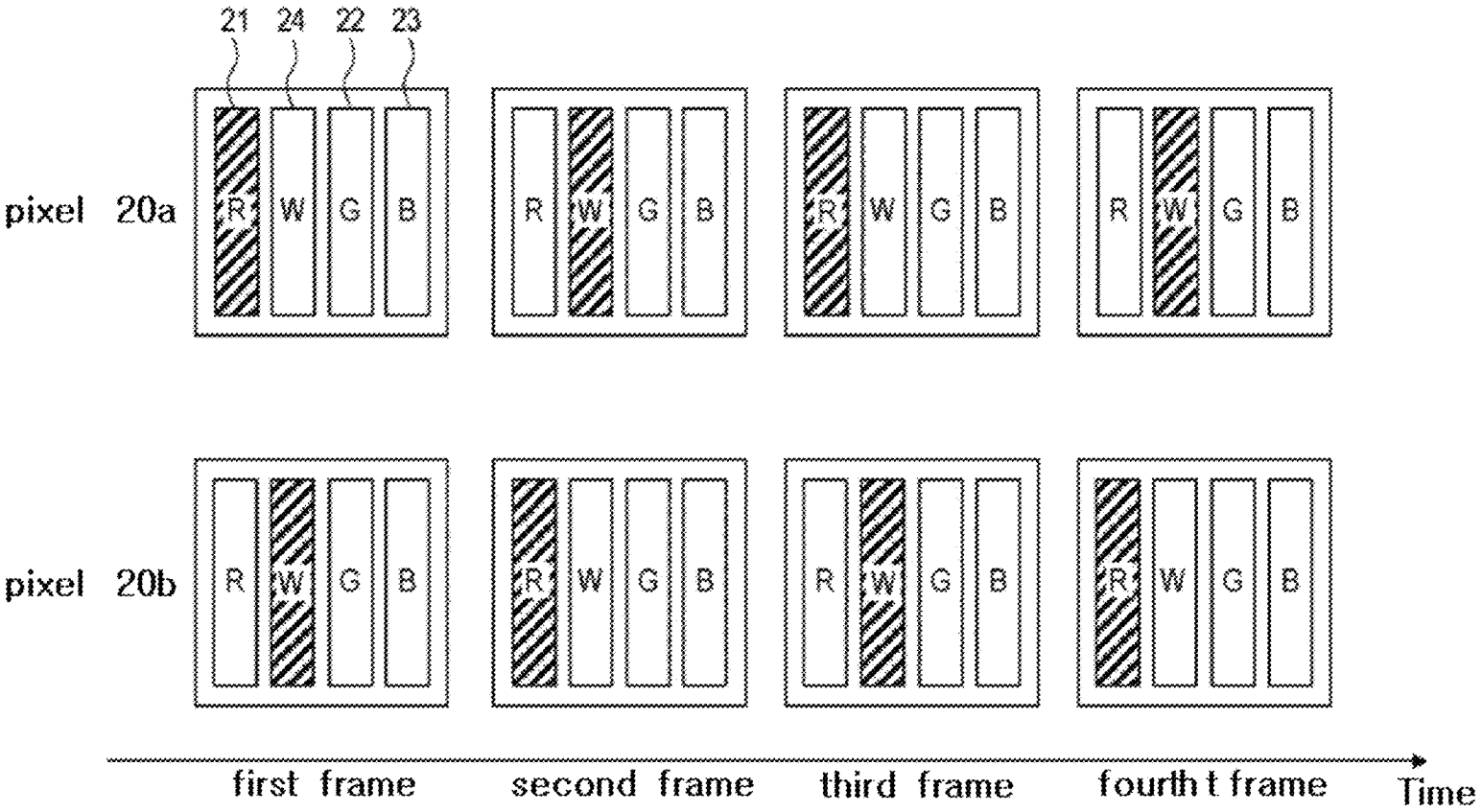
FIG. 7 is a view showing display states of a selection pixel and a non-selection pixel of a display device according to a first embodiment of the present disclosure.

FIG. 7 is a view showing display states of a selection pixel and a non-selection pixel of a display device according to a first embodiment of the present disclosure. In FIG. 7, two pixels 20*a* and 20*b* among the plurality of pixels 20 have display states of 4 frames. The pixel 20*a* is a non-selection pixel in the first and third frames and is a selection pixel in the second and fourth frames. The pixel 20*b* is a non-selection pixel in the second and fourth frames and is a selection pixel in the first and third frames. A hatched portion of FIG. 7 corresponds to a sub-pixel having a luminance of 0 and an off state, and a non-hatched portion of FIG. 7 corresponds to a sub-pixel having a luminance other than 0 and an on state.

As shown in a row of the pixel 20*a* of FIG. 7, since the RGBW conversion is performed to the pixel 20*a* of a non-selection pixel during the first and third frames, the sub-pixel 21 of a red color has a luminance of 0. Since the RGBW conversion is not performed to the pixel 20*a* of a selection pixel during the second and fourth frames, the sub-pixel 24 of a white color has a luminance of 0 and the sub-pixels 21, 22 and 23 of red, green and blue colors have a luminance other than 0. In the display device according to the first embodiment, a display is performed such that the luminances of the red, green and blue sub-pixels 21, 22 and 23 are not 0 when each pixel becomes a selection pixel. Further, the selection and the non-selection are alternated with each other by a predetermined period (frame).

As shown in a row of the pixel 20*b* of FIG. 7, since the RGBW conversion is performed to the pixel 21*a* of a non-selection pixel during the second and fourth frames, the sub-pixel 21 of a red color has a luminance of 0. Since the RGBW conversion is not performed to the pixel 20*b* of a selection pixel during the first and third frames, the sub-pixel 24 of a white color has a luminance of 0 and the sub-pixels 21, 22 and 23 of red, green and blue colors have a luminance other than 0. In the display device according to the first embodiment, the different selection is performed at the different timing. Further, the selection pixel and the non-selection pixel are alternated with each other by a predetermined period (frame).

An effect of the selection where the RGBW conversion is not performed to each pixel will be illustrated hereinafter. When the steps S103 and S104 of FIG. 5 are not performed and the RGBW conversion is always performed, the sub-pixel 21 of a red color of the pixels 20*a* and 20*b* of FIG. 7 always has an off state. A voltage lower than the threshold voltage is applied to the gate of the driving transistor M2 of the sub-pixel 21 of a red color such that the driving transistor M2 is turned off. The voltages applied to the gate of the driving transistor M2 of the sub-pixels of the off and on states are greatly different from each other.

When the voltage is continuously applied to the gate of the driving transistor M2, a phenomenon that the threshold voltage is shifted occurs due to a charge trap in a channel. The voltage compensation of the step S107 is performed for compensating the shift (variation) of the threshold voltage. A shift direction of the threshold voltage depends on a magnitude of the applied voltage, especially a difference between the applied voltage and the threshold voltage. Since the difference between the applied voltage and the threshold voltage in the sub-pixel of the off state and the difference between the applied voltage and the threshold voltage in the sub-pixel of the on state are opposite to each other, the shift direction of the sub-pixel of the off state and the shift direction of the sub-pixel of the on state are opposite to each other. In the voltage compensation of the step S107, compensation along an opposite direction to the other sub-pixel is required for the sub-pixel of the off state. However, the compensation of the threshold voltage shift along an opposite direction may be difficult because of reasons such that sensing the threshold voltage shift along an opposite direction is hard and the compensation range has a limitation.

As a result, in the display device according to the first embodiment, the off state of one sub-pixel is not maintained for a long time period by stopping the RGBW conversion with a predetermined frequency. For example, as shown in FIG. 7, the sub-pixel 21 of a red color is controlled to occasionally have the on state with a predetermined frequency. Since the state where the voltage of the gate of the driving transistor M2 is equal to or lower than the threshold voltage is not maintained for a long time period, the threshold voltage shift along the opposite direction is reduced and the voltage compensation is easily performed.

In the display device according to the first embodiment, the timing controller 1 properly performs compensation of the threshold voltage variation of the driving transistor M2 in the pixel 20.

The frequency where each pixel is selected as the selection pixel may be determined within a range of reducing the threshold voltage shift along the opposite direction. For example, when the minimum frequency for reducing the threshold voltage shift along the opposite direction is 1 time per n second and the frame number per 1 second is m, the selection ratio of each pixel may be equal to or greater than 1/mn [times/frame]. When the driving transistor M2 is required to have the on state with the frequency of 1 time per 0.5 second for reducing the threshold voltage shift along the opposite direction and the frame number per 1 second is 120, the minimum selection ratio may be 1/(0.5*120)=1/60 [times/frame]. In the step S103, the pixel is selected with the ratio of 1 time per 60 frames and is not selected with the ratio of 59 times per 60 frames.

The selection may be performed randomly or periodically. For example, the random selection may include an algorithm where the pixel is selected with the ratio of 1/mn based on a random number. The periodic selection may include an algorithm where the pixel is selected with a constant frame interval corresponding to 1 time per mn frames based on the frame number.

In a display device according to a second embodiment, a method of selecting a pixel by a selection part 13 will be illustrated. Illustration on the basic structure of the display device according to the second embodiment the same as that of the display device according to the first embodiment will be omitted.

As illustrated in the display device according to the first embodiment, the selection frequency of the pixel by the selection part 13 may be determined within a range of reducing the threshold voltage shift along the opposite direction. However, since the RGBW conversion is not performed in the selection pixel and the sub-pixel 24 of a white color is not used, the power consumption increases as the selection ratio increases. As a result, reduction in the power consumption and reduction in the threshold voltage shift may have a trade-off relation. Accordingly, a method of determining the selection ratio for reducing the power consumption and the threshold voltage shift with a proper balance will be illustrated in the display device according to the second embodiment.

In the display device according to the second embodiment, the selection part 13 determines the selection ratio from a parameter based on the gray levels of the red, green and blue colors of the corresponding pixel in the RGB data and each pixel is selected with the selection ratio. The parameter is a reference value used in calculation of the selection ratio. For example, the parameter may be a pixel luminance calculated from the gray levels of the red, green and blue colors of the pixel. Since the pixel luminance has a strong relation to the power consumption of the pixel, the pixel luminance is a proper reference for calculation of the selection ratio. Further, the parameter may be a minimum value min($L_R$, $L_G$, $L_B$) of the gray levels of the red, green and blue colors. The minimum value of the gray levels may be easily calculated from the RGB data. As a result, the calculation is simplified by using the minimum value of the gray levels as the parameter. It will be illustrated hereinafter that the parameter is the pixel luminance.

Figure 8:
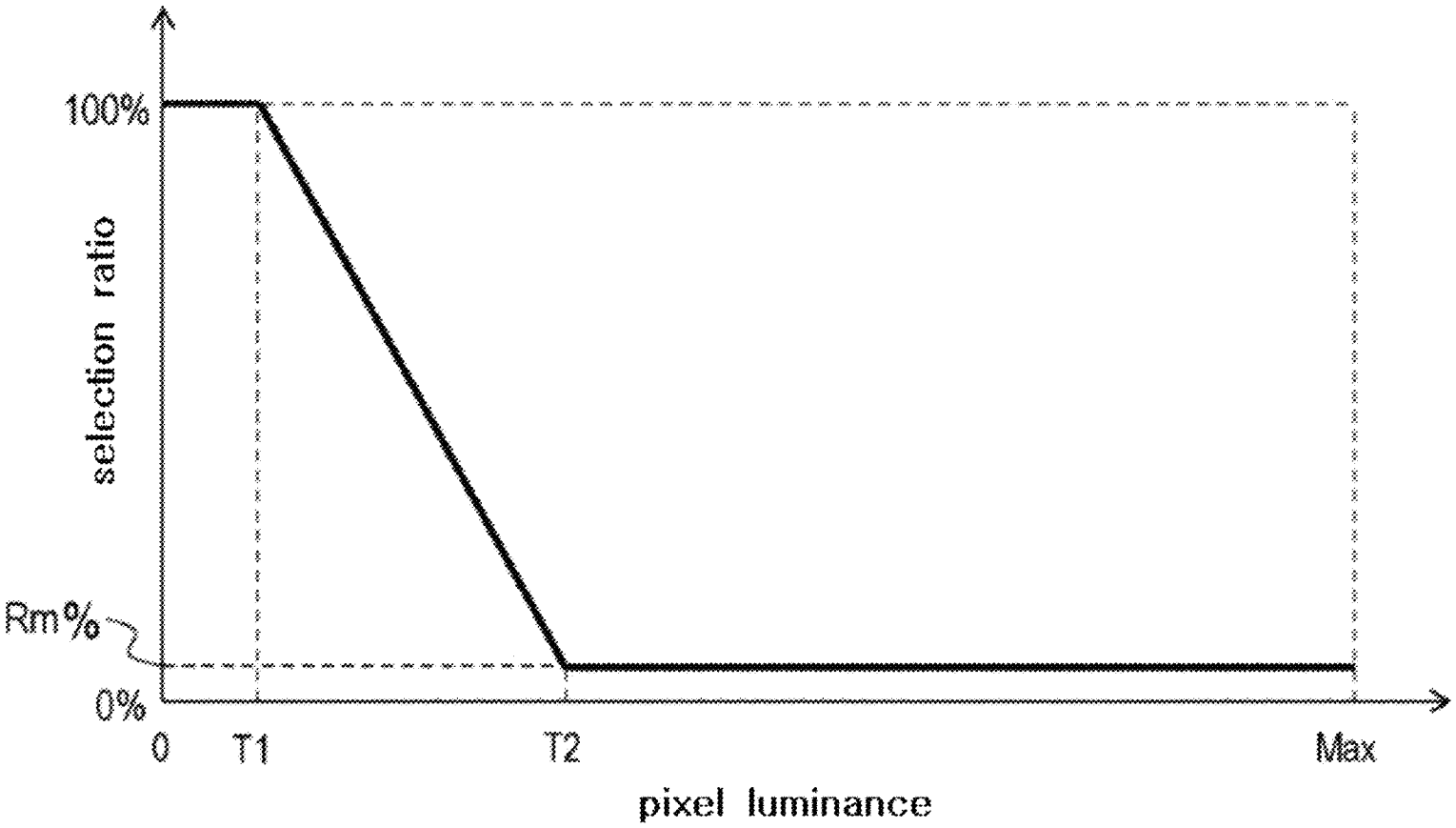
FIG. 8 is a graph showing a relation of a selection ratio and a pixel luminance in a display device according to a first embodiment of the present disclosure.

FIG. 8 is a graph showing a relation of a selection ratio and a pixel luminance in a display device according to a first embodiment of the present disclosure. The selection part 13 determines a selection ratio from a pixel luminance using a relation of FIG. 8. A horizontal axis of FIG. 8 represents the pixel luminance. A point of 0 of the horizontal axis corresponds to a black color, and a point of Max of the horizontal axis corresponds to a white color having a maximum luminance (most bright on state). Points T1 and T2 of the horizontal axis are first and second threshold values, respectively. A vertical axis of FIG. 8 represents the selection ratio. A point of 100% of the vertical axis means that the corresponding pixel is absolutely selected. A point of Rm % is a lowest value of the selection ratio, which is greater than 0%.

When the pixel luminance is equal to or smaller than the first threshold value T1, the selection ratio may be 100%. When the pixel luminance is equal to or greater than the second threshold value T2, the selection ratio may be Rm %. When the pixel luminance is between the first and second threshold values T1 and T2, the selection ratio may monotonously decrease with respect to the pixel luminance (as the pixel luminance increases). Although the selection ratio linearly decreases between the first and second threshold values T1 and T2 in the first embodiment, the selection ratio may decrease in a round shape or a stair step shape between the first and second threshold values T1 and T2 in another embodiment.

Figure 9:
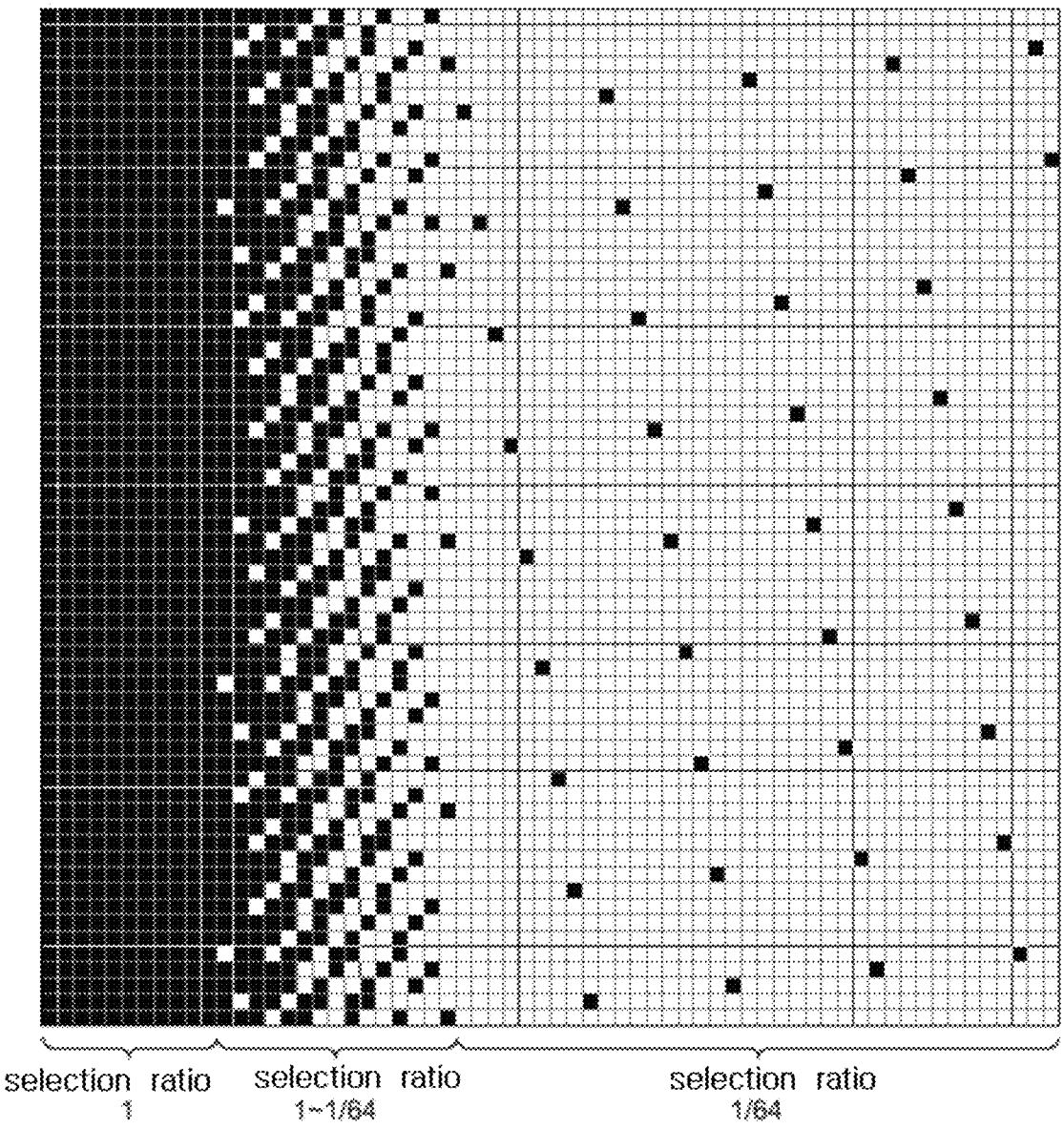
FIG. 9 is a view showing a distribution of a selection pixel of one frame in a display device according to a second embodiment of the present disclosure.

FIG. 9 is a view showing a distribution of a selection pixel of one frame in a display device according to a second embodiment of the present disclosure. FIG. 9 shows the distribution of the selection pixel when an image where a luminance monotonously increases from 0% to 100% along a direction from a left portion to a right portion is displayed in a display unit. The display unit includes (64 pixels)*(64 pixels). In FIG. 9, a black section represents the selection pixel, and a white section represents the non-selection pixel.

A selection algorithm used for FIG. 9 will be illustrated hereinafter. In this selection algorithm, a judgement function f(x, y, k) is calculated, and it is determined due to a relation of the judgement function f(x, y, k) and a judgement reference value whether a pixel is the selection pixel or not. The judgement function f(x, y, k) may be calculated according to the following equation.

$$f(x,y,k)=\mathrm{mod}(23(9y+x+k),64)$$

Here, x, y are a coordinate (column number and row number) of the pixel, k is a frame number, and mod(p, q) is a remainder when p is divided by q.

In an algorithm where the pixel satisfying a condition of 'f=0' or 'f+40≥gray level number of pixel (0~255)' is selected as the selection pixel, a result of determining whether one of a whole of (64 pixels)*(64 pixels) is the selection pixel or not is shown in FIG. 9. In the left portion having a relatively low luminance, the selection ratio is 1 (100%) and all pixels are always selected. In the right portion having a relatively high luminance, the selection ratio is 1/64 and the pixel is selected with a ratio of 1 pixel per 64 pixels. The selection ratio is constantly 1/64 in the right portion having a relatively high luminance. In a portion between the left portion and the right portion, the selection ratio varies from 1 to 1/64 according to the luminance and the selection ratio decreases as the luminance increases. As a result, the selection ratio with respect to the luminance as shown in FIG. 8 is performed. A value of the judgement function f(x, y, k) varies by frame for each pixel, and the pixel is selected 1 time per 64 frames when the selection ratio is 1/64. Accordingly, each pixel is selected with a constant interval.

In the algorithm, the selection ratio decreases as the luminance increases and the power consumption increases. As a result, when the luminance has a relatively high value, the power consumption may be reduced by increasing the frequency for using the pixel 24 of a white color. When the luminance has a relatively low value and the power consumption has a relatively low value, reduction of the threshold voltage shift due to a relatively high selection ratio is preferable to reduction of the power consumption using the sub-pixel 24 of a white color, and the selection ratio increases. Accordingly, reduction of the power consumption and reduction of the threshold voltage shift are harmoniously obtained.

In the right portion of FIG. 9 where the selection ratio is 1/64, the selection pixel is disposed not to be continued along a vertical direction and a horizontal direction. The selection pixel is disposed along a diagonal direction different from the vertical direction and the horizontal direction. When a user watches the display unit, it becomes difficult that the user recognizes a difference in a display state of the selection pixel and the non-selection pixel.

Figure 10:
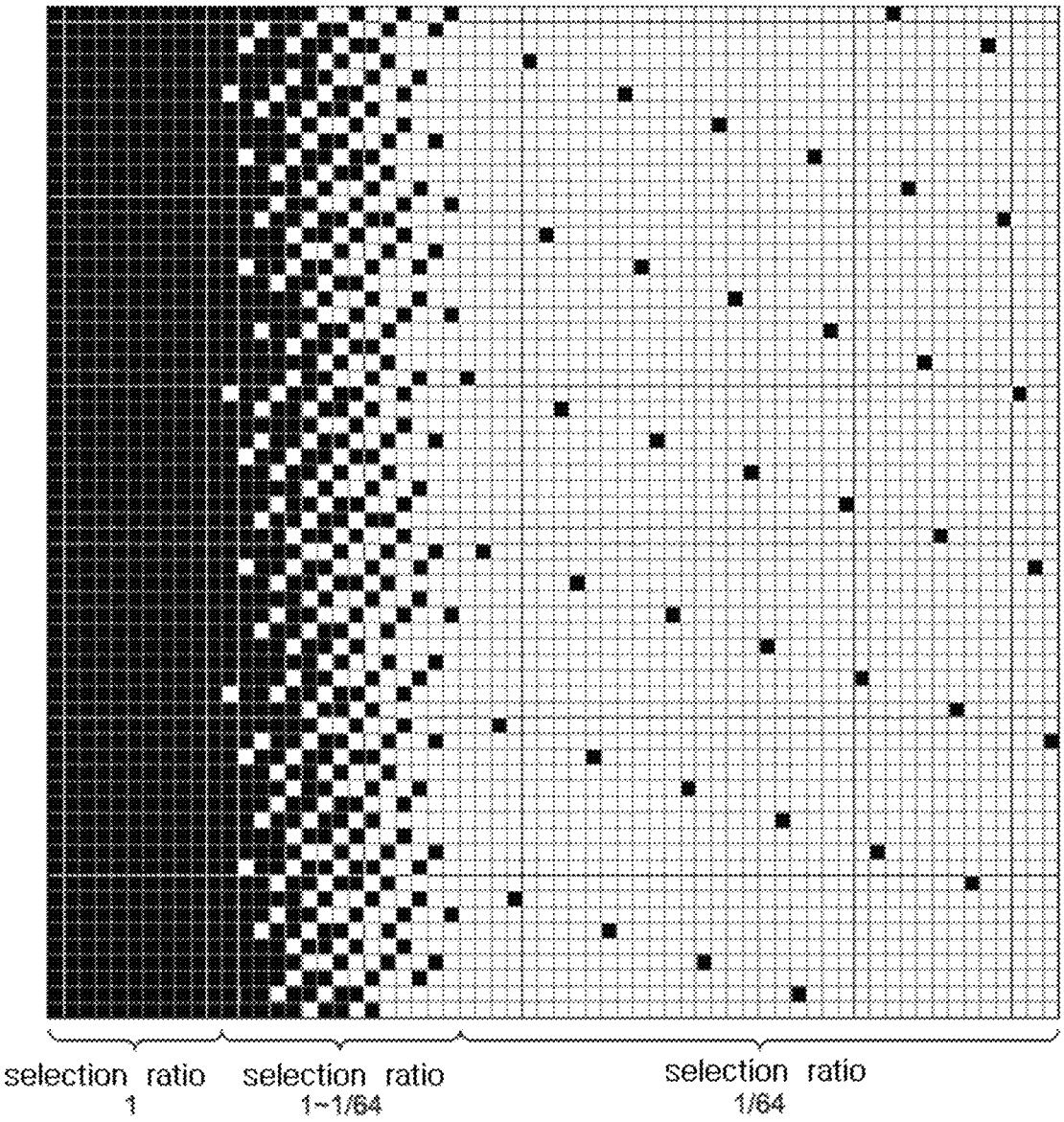
FIG. 10 is a view showing a distribution of a selection pixel of another frame in a display device according to a second embodiment of the present disclosure.

FIG. 10 is a view showing a distribution of a selection pixel of another frame in a display device according to a second embodiment of the present disclosure. The judgement function f(x, y, k) may be calculated according to the following equation.

$$f(x,y,k)=\mathrm{mod}(23(29y+x+k),64)$$

Illustration on the algorithm and the method except for the judgement function of FIG. 10 the same as that of FIG. 9 will be omitted. The selected pixel of FIG. 10 in another frame is different from the pixel of FIG. 9 in one frame.

In the right portion of FIG. 10 where the selection ratio is 1/64, the selection pixel is disposed not to be continued along a vertical direction and a horizontal direction. While the selection pixel of FIG. 9 is disposed along a diagonal direction forward a right upper region, the selection pixel of FIG. 10 is disposed along a diagonal direction forward a right lower region. It is preferable to change a disposition direction of the selection pixel by frame. Since the disposition direction of the selection pixel is changed when a user watches a moving picture, it becomes more difficult that the user recognizes a difference in a display state of the selection pixel and the non-selection pixel.

In the display device according to the second embodiment of the present disclosure, the timing controller 1 performs reduction of the power consumption and reduction of the threshold voltage shift with a proper balance with the effect of the first embodiment.

In a display device according to a third embodiment, a method of selecting a pixel by a selection part 13 different from that of the second embodiment will be illustrated. Illustration on the basic structure of the display device according to the third embodiment the same as that of the display device according to the first embodiment will be omitted. Illustration on a part of the selection method according to the third embodiment the same as that of the second embodiment will be omitted.

Figure 11:
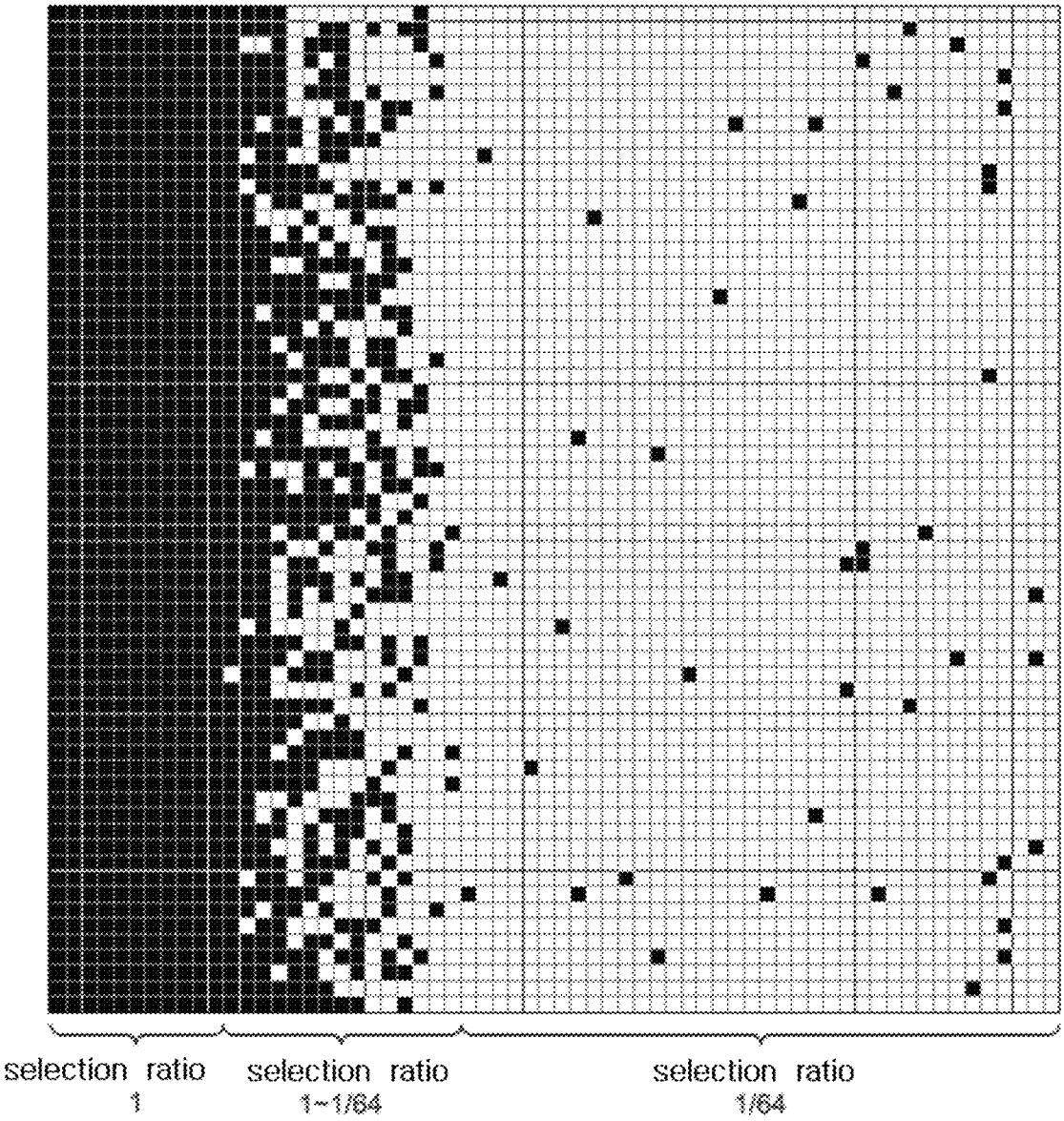
FIG. 11 is a view showing a distribution of a selection pixel of one frame in a display device according to a third embodiment of the present disclosure.

FIG. 11 is a view showing a distribution of a selection pixel of one frame in a display device according to a third embodiment of the present disclosure. FIG. 11 shows the distribution of the selection pixel when an image where a luminance monotonously increases from 0% to 100% along a direction from a left portion to a right portion is displayed in a display unit.

A selection algorithm used for FIG. 11 will be illustrated hereinafter based on the algorithm used for FIG. 9. In the selection algorithm of the third embodiment, the judgement function f(x, y, k) of the second embodiment is substituted with a random number of 0 to 63. A function or an apparatus generating the random number is set such to return a new value by frame. In the algorithm where the pixel satisfying a condition of 'f=0' or 'f+40≥gray level number of pixel (0~255)' is selected as the selection pixel, a result of determining whether one of a whole of (64 pixels)*(64 pixels) is the selection pixel or not is shown in FIG. 11.

In the left portion having a relatively low luminance of FIG. 11, the selection ratio is 1 (100%) and all pixels are selected. In the right portion having a relatively high luminance, the selection ratio is 1/64 and the pixel is selected with a ratio of 1 pixel per 64 pixels. In a portion between the left portion and the right portion, the selection ratio varies from 1 to 1/64 according to the luminance. As a result, the selection ratio with respect to the luminance as shown in FIG. 8 is performed.

Figure 12:
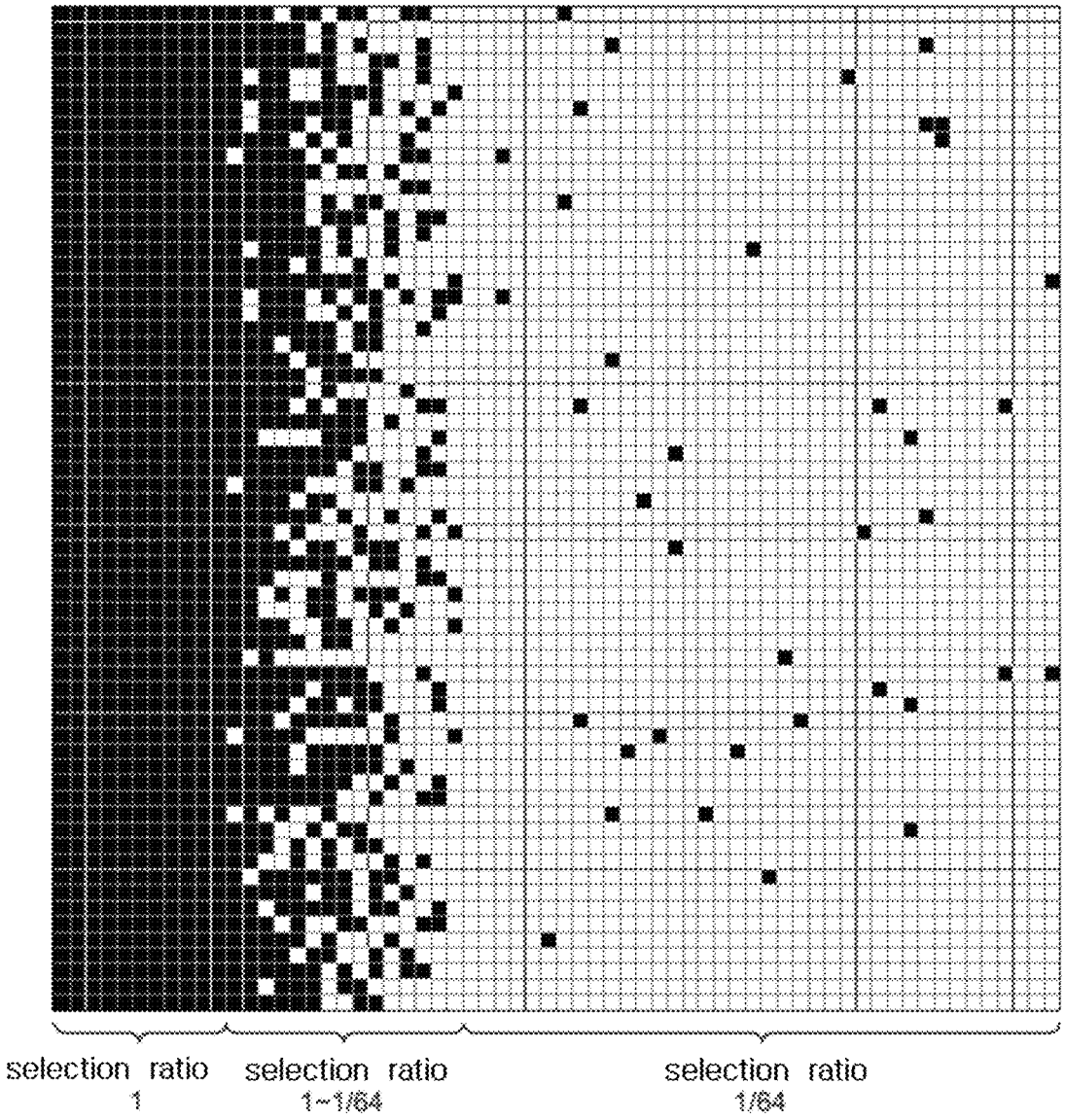
FIG. 12 is a view showing a distribution of a selection pixel of another frame in a display device according to a third embodiment of the present disclosure.

FIG. 12 is a view showing a distribution of a selection pixel of another frame in a display device according to a third embodiment of the present disclosure. The selected pixel of FIG. 12 in another frame is different from the pixel of FIG. 11 in one frame. For each pixel, when the selection ratio is 1/64, the pixel is selected with a ratio of 1 time per 64 frames. As a result, each pixel is statistically selected with a predetermined ratio according to the luminance instead of a predetermined interval.

In the display device according to the third embodiment of the present disclosure, the timing controller 1 has the same effect as that of the second embodiment. Further, since the selection pixel is randomly disposed, it becomes more difficult that a user recognizes a difference in a display state of the selection pixel and the non-selection pixel when the user watches the display unit.

In a display device according to a fourth embodiment, a pixel structure where a defect detected in one of the plurality of sub-pixels 21, 22, 23 and 24 in an inspection process of the display device is repaired will be illustrated. Illustration on the basic structure except for a repair line of the display device according to the fourth embodiment the same as that of the display device according to the first embodiment will be omitted. The selection method by the selection part 13 according to the second and third embodiments may be applied to the display device according to the fourth embodiment.

Figure 13:
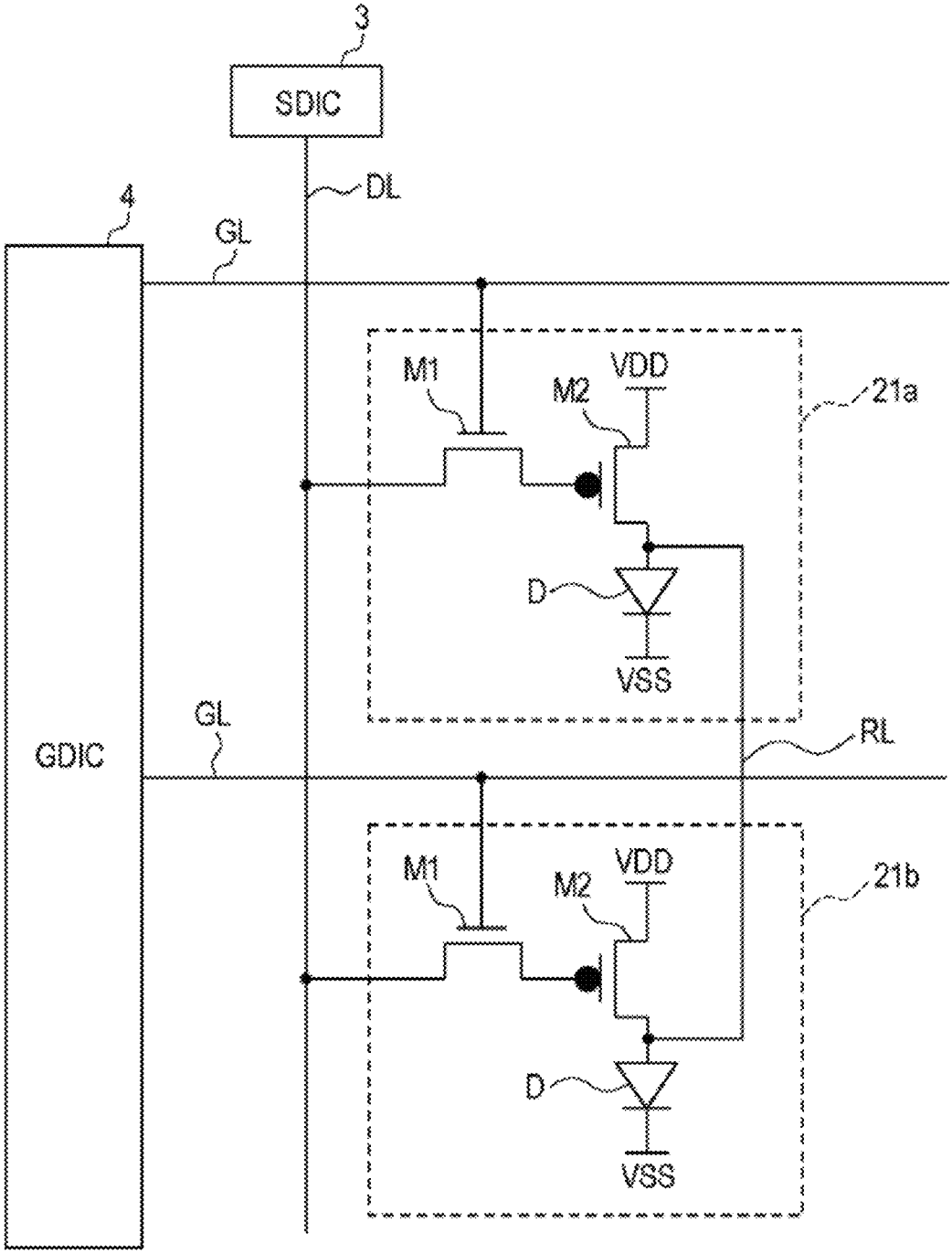
FIG. 13 is a view showing a sub-pixel of a panel of a display device according to a fourth embodiment of the present disclosure.

FIG. 13 is a view showing a sub-pixel of a panel of a display device according to a fourth embodiment of the present disclosure. In FIG. 13, the panel 2 includes sub-pixels 21*a* and 21*b* capable of being connected by a repair line RL. The repair line RL may connect anodes of diodes D of the sub-pixels 21*a* and 21*b*. The sub-pixels 21*a* and 21*b* may be disposed at the same column and the different rows and may have the same color.

When the forming process of the display panel 2 is completed, the repair line RL is formed such that the sub-pixels 21*a* and 21*b* are not connected to each other. When a defect such as deterioration of forming a transistor is detected in one of the sub-pixels 21*a* and 21*b* in an inspection process, a repair process may be performed such that the sub-pixels 21*a* and 21*b* are electrically connected to each other by melting the repair line RL through a laser irradiation and welding the sub-pixels 21*a* and 21*b*. As a result, even when the transistor, etc., of one of the sub-pixels 21*a* and 21*b* does not operates, a current is supplied to the diode D through the adjacent sub-pixel and display deterioration such as a pixel defect, etc., is repaired.

In the pixel structure of the fourth embodiment, both of the two sub-pixels 21*a* and 21*b* capable of being connected by the repair line RL may be selected or may not be selected in determination of the selection pixel of the second and third embodiments. It is not preferable that one of the two sub-pixels 21*a* and 21*b* is selected as the selection pixel and the other of the two sub-pixels 21*a* and 21*b* is not selected as the selection pixel in determination of the selection pixel of the second and third embodiments. A current flows through the two diodes D connected to each other due to the repair process at the same timing. After the repair process, the sub-pixels 21*a* and 21*b* do not operate such that one has the on state and the other has the off state, and it is preferable that both of the sub-pixels 21*a* and 21*b* are selected as the selection pixel or the non-selection pixel.

Figure 14:
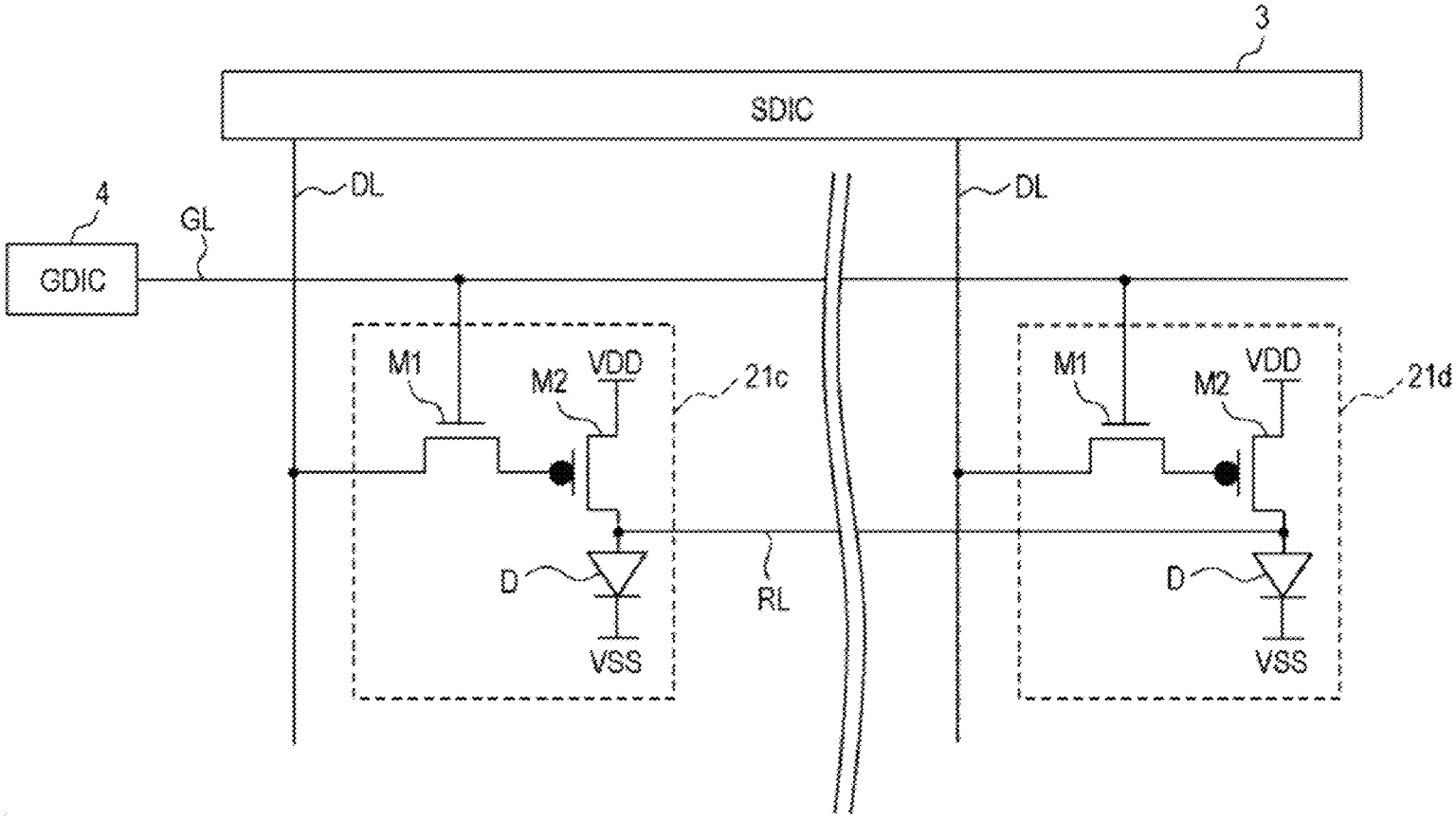
FIG. 14 is a view showing a sub-pixel of a panel of a display device according to a fifth embodiment of the present disclosure.

In a display device according to a fifth embodiment, a pixel structure for a repair process is different from that of the fourth embodiment. FIG. 14 is a view showing a sub-pixel of a panel of a display device according to a fifth embodiment of the present disclosure. In FIG. 14, the panel 2 includes sub-pixels 21*c* and 21*d* capable of being connected by a repair line RL. The repair line RL may connect anodes of diodes D of the sub-pixels 21*c* and 21*d*. The sub-pixels 21*c* and 21*d* may be disposed at the same row and the different columns and may have the same color.

In the pixel structure of the fifth embodiment, an effect such that display deterioration such as a pixel defect, etc., is repaired is obtained similarly to the fourth embodiment. Further, it is preferable that both of the sub-pixels 21*c* and 21*d* are selected as the selection pixel or the non-selection pixel in determination of the selection pixel similarly to the fourth embodiment.

In a display device according to the present disclosure, compensation of a threshold voltage variation of a transistor in a pixel is properly performed.

The above embodiments are several examples where the present invention is applied, and the technical scope of the present invention should not be interpreted limitedly by the above embodiments. It will be apparent to those skilled in the art that various modifications and variation can be made in the present invention without departing from the spirit or scope of the invention. For example, it is comprehended that an embodiment where some parts of one embodiment is added to another embodiment or is substituted with some parts of another embodiment is an embodiment where the present invention is applied. Thus, it is intended that the present invention cover the modifications and variations of this invention provided they come within the scope of the appended claims and their equivalents.

In the above embodiments, an apparatus structure such of the display device, the pixel 20, etc., is an example and is not limited thereto. For example, a portion or a whole of a function the timing controller 1, the panel 2, the source driver IC 3 and the gate driver IC 4 may be integrated as a single unit.

In the above embodiments, the display may correspond to a high dynamic range (HDR). In the HDR, the luminances of the red, green and blue colors may exceed the maximum luminance (100%) shown in FIG. 6. In that case, to obtain the output luminance over the maximum luminance using the sub-pixel 24 of a white color, it is preferable that the pixel having a luminance over the maximum luminance is selected as the non-selection pixel in the step S103.

It will be apparent to those skilled in the art that various modifications and variations can be made in the present disclosure without departing from the technical idea or scope of the disclosure. Thus, it is intended that the present disclosure cover the modifications and variations of this disclosure provided they come within the scope of the appended claims and their equivalents.

What is claimed is:

1. A display control device for controlling a display device including a display unit including a plurality of pixels, each including a first sub-pixel of a first color, a second sub-pixel of a second color, a third sub-pixel of a third color, and a fourth sub-pixel of a fourth color, comprising:

an input part configured to receive an input signal, including gray levels of the first color, the second color, and the third color constituting a color for each of the plurality of pixels;

a selection part configured to select:

at least one of the plurality of pixels as a selection pixel; and another of the plurality of pixels as a non-selection pixel; and an output part configured to output an output signal controlling luminances of the first sub-pixel, the second sub-pixel, the third sub-pixel, and the fourth sub-pixel, based on the input signal, wherein at least one of the first sub-pixel, the second sub-pixel, and the third sub-pixel, of the non-selection pixel, is controlled to have a luminance of 0 according to the output signal, wherein the fourth sub-pixel of the selection pixel is controlled to have a luminance of 0 according to the output signal, and wherein at least one of the first sub-pixel, the second sub-pixel, the third sub-pixel, and the fourth sub-pixel, for all of the plurality of pixels, is controlled to have a luminance of 0 according to the output signal for each frame.

2. The device of claim 1, wherein the selection part is further configured to change the selection pixel with a predetermined interval.

3. The device of claim 1, wherein the selection part is further configured to select the selection pixel based on a random number.

4. The device of claim 1, wherein the selection part is further configured to differently select the selection pixel with respect to each of a plurality of frame images displayed in the display unit at different timing.

5. The device of claim 4, wherein the selection part is further configured to select the selection pixel based on frame numbers of the plurality of frame images.

6. The device of claim 1, wherein a frequency for selecting the selection pixel by the selection part is determined according to a reference value based on gray levels of the first color, the second color, and the third color of the selection pixel.

7. The device of claim 6, wherein the selection part is further configured to always select the selection pixel having the reference value equal to or smaller than a first threshold value.

8. The device of claim 6, wherein:

the selection part is further configured to select the selection pixel having the reference value greater than a first threshold value; and the frequency decreases as the gray level increases.

9. The device of claim 6, wherein the selection part is further configured to:

select the selection pixel having the reference value greater than a second threshold value; and the frequency includes a constant value.

10. The device of claim 1, wherein:

the plurality of pixels are disposed in a plurality of rows and a plurality of columns; and the selection part is further configured to select the selection pixel, such that the selection pixel is disposed along a direction different from a direction of the plurality of rows and a direction of the plurality of columns.

11. The device of claim 1, wherein, when gray levels of the first color, the second color, and the third color exceed a maximum luminance of the first sub-pixel, the second sub-pixel, and the third sub-pixel in one of the plurality of pixels, the selection part is further configured to select the one of the plurality of pixels as the non-selection pixel.

12. The device of claim 1, wherein:

emission devices in two of the plurality of pixels are electrically connected to each other by a repair line; and the selection part is further configured to select the two of the plurality of pixels as one of the selection pixel and the non-selection pixel.

13. The device of claim 1, wherein:

the first color is a red color;

the second color is a green color;

the third color is a blue color; and the fourth color is a mixed color of the first color, the second color, and the third color.

14. The device of claim 13, wherein the fourth color is different from a color including the first color, the second color, and the third color with a same mixture ratio.

15. The device of claim 1, wherein each of the first sub-pixel, the second sub-pixel, the third sub-pixel, and the fourth sub-pixel includes a light emitting diode.

16. The device of claim 15, wherein:

the first sub-pixel further includes a first color filter of the first color;

the second sub-pixel further includes a second color filter of the second color;

the third sub-pixel further includes a third color filter of the third color; and the fourth sub-pixel further includes a fourth color filter of the fourth color.

17. The device of claim 15, wherein the light emitting diode is configured to emit light of the fourth color.

18. The device of claim 15, wherein:

each of the first sub-pixel, the second sub-pixel, the third sub-pixel, and the fourth sub-pixel includes a transistor configured to control a current flowing the light emitting diode; and the transistor is configured to be turned off by the input signal to control the luminance of one of the first sub-pixel, the second sub-pixel, the third sub-pixel, and the fourth sub-pixel to be 0.

19. The device of claim 1, further comprising:

an RGBW conversion part configured to perform an RGBW conversion converting luminance ratios corresponding to the first color, the second color, and the third color of the input signal into luminance ratios corresponding to the first color, the second color, the third color, and the fourth color of the output signal, wherein the RGBW conversion is performed for the non-selection pixel, such that at least one of the first sub-pixel, the second sub-pixel, and the third sub-pixel of the non-selection pixel has a luminance of 0, and wherein the RGBW conversion is omitted for the selection pixel, such that the fourth sub-pixel of the selection pixel has a luminance of 0.

20. The device of claim 1, further comprising an RGBW conversion part configured to:

perform an RGBW conversion converting luminance ratios corresponding to the first color, the second color, and the third color of the input signal into luminance ratios corresponding to the first color, the second color, the third color, and the fourth color of the output signal;

calculate a first component ($W_R$), a second component ($W_G$), and a third component ($W_B$) of a light emitted from the fourth sub-pixel of the non-selection pixel from a first luminance ratio ($Y_R$), a second luminance ratio ($Y_G$), and a third luminance ratio ($Y_B$) of the input signal according to equations:

$$W_R = Y_R/1;$$

$$W_G = Y_G/0.8; \text{ and}$$

$$W_B = Y_B/0.5;$$

calculate a fourth luminance ratio ($Y_W$) from the first component ($W_R$), the second component ($W_G$), and the third component ($W_B$) according to an equation:

$$Y_W = \min(W_R, W_G, W_B); \text{ and}$$

calculate a first luminance ratio ($Y_R'$), a second luminance ratio ($Y_G'$), and a third luminance ratio ($Y_B'$) of the output signal from the first luminance ratio ($Y_R$), the second luminance ratio ($Y_G$), the third luminance ratio ($Y_B$), and the fourth luminance ratio ($Y_W$) according to equations:

$$Y_R' = Y_R - 1Y_W;$$

$$Y_G' = Y_G - 0.8Y_W; \text{ and}$$

$$Y_B' = Y_B - 0.5Y_W.$$

21. The device of claim 1, wherein:

the selection pixel is selected randomly or periodically;

if the selection is random, the selection pixel is selected with a ratio of 1/mn frames based on a random number, where m is a time in seconds, and n is a number of frames per second; and if the selection is periodic, the selection pixel is selected with a constant frame interval corresponding to 1 time per mn frames based on a frame number.

22. A display device, comprising:

a display panel including a plurality of pixels, each including four sub-pixels, the four sub-pixels including:

a first sub-pixel of a first color;

a second sub-pixel of a second color;

a third sub-pixel of a third color; and a fourth sub-pixel of a fourth color, wherein at least one of the first sub-pixel, the second sub-pixel, the third sub-pixel, and the fourth sub-pixel, for all of the plurality of pixels, is controlled to have a luminance of 0 for each frame, wherein the fourth sub-pixel of at least one of the plurality of pixels is controlled to have a luminance of 0, wherein the first sub-pixel, the second sub-pixel, and the third sub-pixel of others of the plurality of pixels are controlled to have a luminance of 0, and wherein a position of the at least one of the plurality of pixels, where the fourth sub-pixel is controlled to have a luminance of 0, is changed according to a frame.

23. A method of controlling a display device including a display unit including a plurality of pixels, each including a first sub-pixel of a first color, a second sub-pixel of a second color, a third sub-pixel of a third color, and a fourth sub-pixel of a fourth color, the method comprising:

inputting an input signal including gray levels of the first color, the second color, and the third color constituting a color for each of the plurality of pixels;

selecting:

at least one of the plurality of pixels as a selection pixel; and another of the plurality of pixels as a non-selection pixel; and outputting an output signal controlling luminances of the first sub-pixel, the second sub-pixel, the third sub-pixel, and the fourth sub-pixel, based on the input signal, wherein at least one of the first sub-pixel, the second sub-pixel, and the third sub-pixel, of the non-selection pixel, is controlled to have a luminance of 0 according to the output signal, wherein the fourth sub-pixel of the selection pixel is controlled to have a luminance of 0 according to the output signal, and wherein at least one of the first sub-pixel, the second sub-pixel, the third sub-pixel, and the fourth sub-pixel, for all of the plurality of pixels, is controlled to have a luminance of 0 according to the output signal for each frame.

* * * * *